United States Patent [19]

Norden

[11] Patent Number: 4,481,496

[45] Date of Patent: Nov. 6, 1984

[54] SWITCHING FUSIBLE APPARATUS

[76] Inventor: Alexander R. Norden, 350 Central Park West, New York, N.Y. 10025

[21] Appl. No.: 423,839

[22] Filed: Sep. 27, 1982

[51] Int. Cl.[3] ..... H01H 85/50

[52] U.S. Cl. ..... 337/213; 337/214

[58] Field of Search ..... 339/88; 337/187, 213, 337/214, 215

[56] References Cited

U.S. PATENT DOCUMENTS 4,329,006 5/1982 Gale ..... 337/213

*Primary Examiner*—Harold Broome

[57] ABSTRACT

The disclosed fusible apparatus has a one-piece molded fuse holder of insulation that receives and largely encloses a glass fuse and enters the cavity of a fuse-holder receptacle endwise, then to be rotated about its longitudinal axis for carrying the fuse in an eccentric orbital path from the initial insertion position into an OFF position and into an ON position, carrying exposed portions of the fuse terminals into engagement with contacts in the fuse-holder receptacle, the fuse holder being detented in its OFF and ON positions and being biased by a spring for ejection in its insertion (release) position.

10 Claims, 13 Drawing Figures

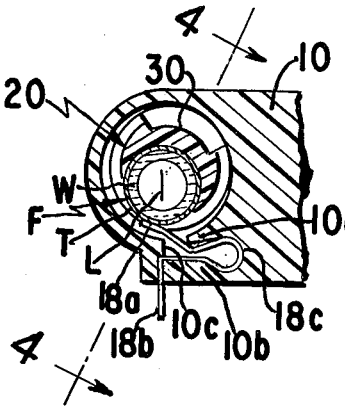
FIG. 7
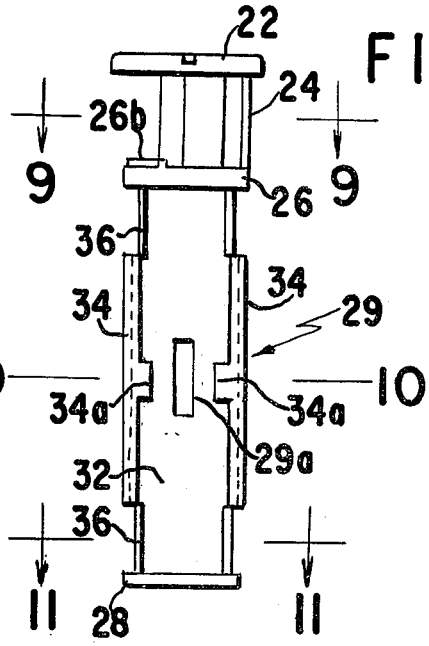
FIG. 8
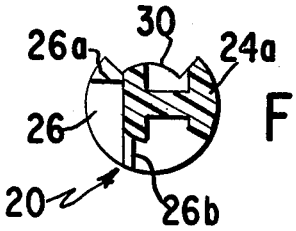
FIG. 9
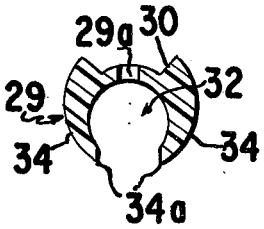
FIG. 10
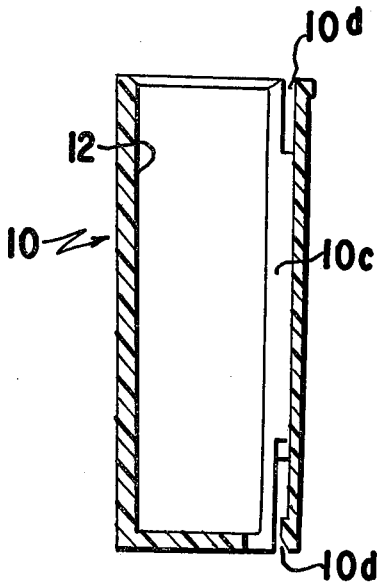
FIG. 12
FIG. 11
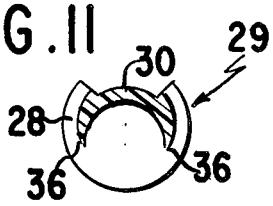
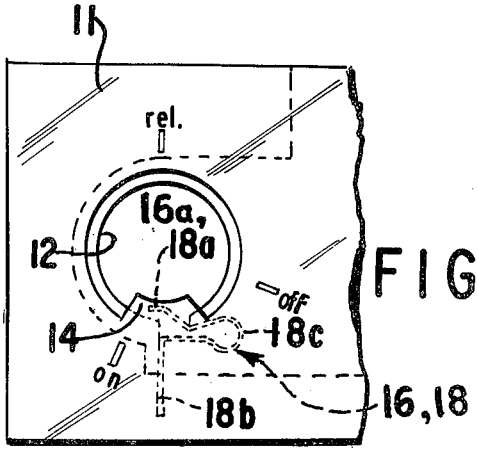
FIG. 13

SWITCHING FUSIBLE APPARATUS

The present invention relates to electrical fuse holders and receptacles.

A variety of fuse holders and receptacles have been devised over the years for the kind of fuse having cylindrical terminals at the ends of a cylindrical wall containing a fusible link. Small fuses of that type commonly have cylindrical walls of glass and for that reason they are often called "glass" fuses.

An object of the present invention resides in providing novel fuse holders, especially fuse holders for glass fuses, and receptacles therefor. More particularly an object of the invention resides in providing a novel fuse holder and receptacle of simplified economical construction, wherein the fuse holder that carries the fuse maintains the fuse terminals deenergized and largely concealed during insertion and removal of the fuse holder. In this respect, the novel fusible apparatus complies with specifications aimed at minimizing hazard. A further object is to provide novel switching fusible apparatus. A further object of the invention resides in providing a novel fuse holder and receptacle having some of the foregoing attributes, and a further object resides in providing novel fuse holders and receptacles combining all such attributes.

The illustrative embodiment of the invention that achieves these objects is described in detail below and shown in the accompanying drawings. That apparatus has a number of novel features and distinctive aspects that serve separately as improvements over prior apparatus of the kind, and those features and aspects when integrated in the illustrative embodiment represent an exemplary advance in the art.

In the illustrative embodiment, the receptacle for an elongated fuse holder has a cylindrical cavity that is open at one end to receive the fuse holder. Electrical terminals in the receptacle are spaced apart along the insertion path of the fuse holder. The fuse holder is inserted lengthwise into the cylindrical cavity of the receptacle in keyed orientation and then it is rotated about its longitudinal axis in the receptacle cavity. The fuse holder has a cavity that receives the fuse and exposes the fuse terminals laterally but only to a limited arcuate extent. After insertion, the fuse holder is rotated about its axis and carries the exposed portions of the fuse terminals into engagement with the receptacle contacts. The foregoing mode of operation is most readily achieved by making the fuse axis parallel to but eccentric of the axis of the fuse holder. Consequently, the fuse with the exposed portions of its terminals moves bodily in an orbital path as the fuse holder rotates.

The fuse terminals avoid contact with the receptacle terminals along their lengthwise path of insertion. The fuse holder provides insulation that largely conceals the fuse terminals, avoiding potential hazard during insertion. The limited exposed areas of the fuse terminals move along a path such that they remain deenergized because they are spaced safely from the terminals in the receptacle. After the fuse holder has been inserted fully into the receptacle, the fuse holder can be rotated into circuit-making condition with complete safety.

The receptacle has a key extending radially inward at the open end of its cylindrical cavity. The receptacle terminals extend a short way into the cylindrical cavity of the receptacle, spaced from each other and from the key, in a row. The fuse holder is relieved along its length so that it can be inserted, passing by the key and the receptacle terminals, without interference by or harm to the receptacle terminals. After the fuse holder has been properly inserted, it is turned selectively into its open-circuit condition or into its circuit-making condition. Rotation of the fuse holder out of its inserting orientation carries a broken-circle shoulder of the fuse holder under the key. This prevents the fuse holder from moving axially (endwise) out of the receptacle.

A spring at the bottom of the receptacle cavity biases the broken-circle shoulder of the fuse holder against the key. Detent formations on that shoulder cooperate with the key to retain the fuse holder in its selected open-circuit position or its circuit-making position. The key and the shoulder represent obstructions against removal of the fuse holder that are biased into mutual cooperation by the spring.

The foregoing and other objects and novel features of the invention will be best appreciated from the following detailed description of the illustrative embodiment shown in the accompanying drawings.

In the drawings:

FIG. 7 is a cross-section of the apparatus in FIGS. 1–4 viewed at the plane 7—7 in FIG. 2;

FIG. 8 is an elevation of the fuse holder, viewed from the right in the assembly of FIG. 4;

Figure 1:
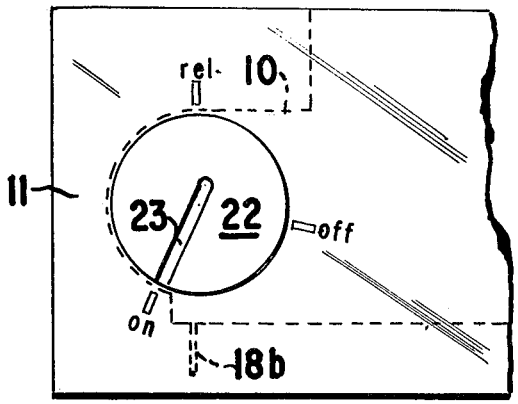
FIG. 1 is an enlarged top plan view of fusible apparatus as an illustrative embodiment of the invention, including a fuse holder in its "ON" position in a fuse-holder receptacle.
Figure 3:
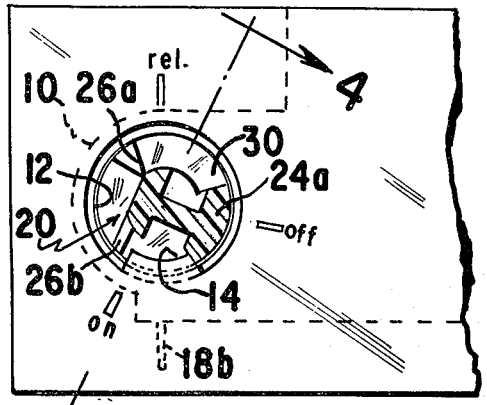
FIG. 3 is a cross-section of the apparatus of FIGS. 1 and 2 at the plane 3—3 in FIG. 2.
Figure 2:
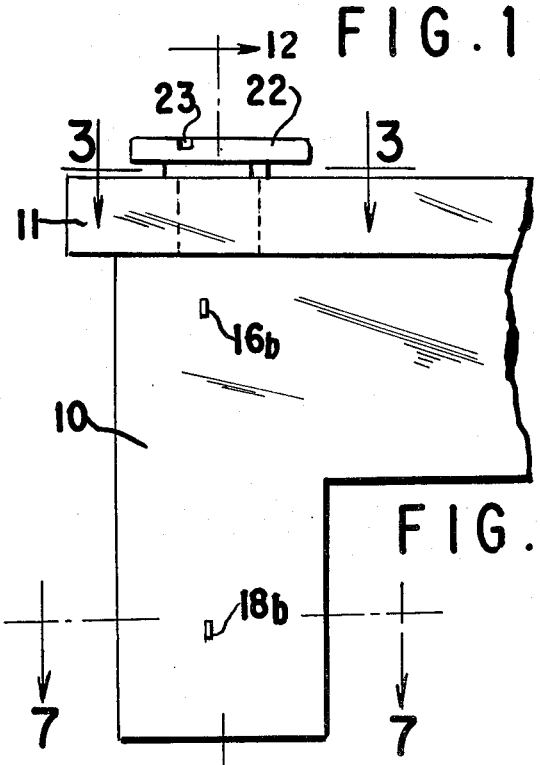
FIG. 2 is a side view of the fusible apparatus of FIG. 1.

FIGS. 9, 10 and 11 are cross-sectional views at the planes 9—9, 10—10, and 11—11 in FIG. 8;

FIG. 12 is a cross-section of part of the fuse holder cavity as viewed at the plane 12—12 in FIG. 2; and FIG. 13 is a top plan view of the fuse holder receptacle of FIGS. 1–6.

Figure 4:
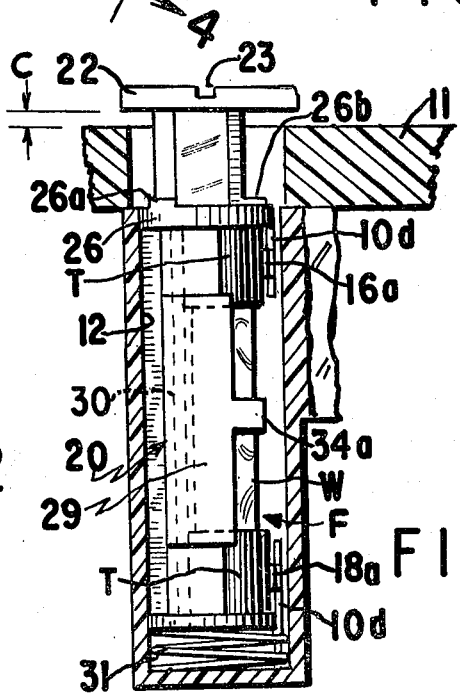
FIG. 4 is an elevation of the assembly of FIGS. 1–3 viewed from the plane 4—4 in FIGS. 3 and 7, showing the receptacle in cross-section.
Figure 5:
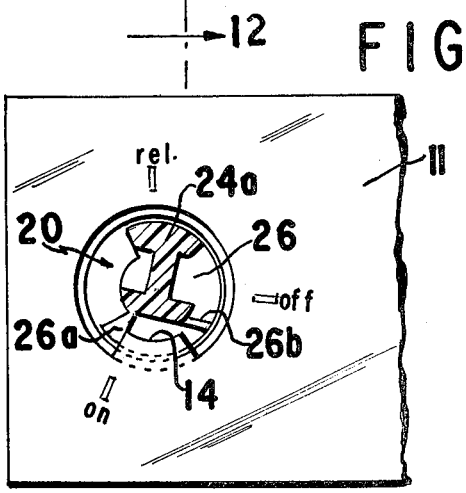
FIGS. 5 and 6 are views corresponding to FIG. 2 except that the fuse holder is in its "OFF" position and its "REL" (release) position, respectively, in FIGS. 5 and 6.

Referring now to the drawings, body 10 and plate 11 of electrical insulation form a fuse-holder receptacle. Body 10 is a molded part having a cylindrical cavity 12, closed at the bottom and open at the top. Plate 11 has an opening generally aligned with cavity 12, except that it has a key 14 overhanging the cavity. Key 14 extends through a small arc, e.g. 80°, about the axis of cavity 12. Two terminals 16 and 18 of resilient metal extend through and are fixed in the wall of the receptacle. Portions of these two terminals form contacts **16*a* and 18*a* (FIGS. 4, 7 and 13) that bear tangentially against respective fuse terminals. An elongated portion 18*c* of terminal 18 interconnects external terminal portion 18*b* and contact portion 18*a*. Portion 18*c* is bent back on itself and is captive in a recess in the wall of the receptacle, to provide resilience and to bias contact 18*a* against terminal T of the fuse F when the fuse holder is in its "ON" position (FIGS. 4 and 7). This bias presses the fuse holder oppositely against the surface of cavity 12. The receptacle cavity is slightly tapered to provide a molding draft angle. End walls 26 and 28 differ slightly in diameter, correspondingly. They fit somewhat loosely in the cavity, yet the fuse holder and cavity 12 have in effect a common axis about which the fuse holder rotates. Terminal 18 has proper shape and resilience to assure firm engagement of contact 18***a* with terminal T. The radially inward movement of contact 18*a* due to the bias of portion 18*c* is limited, in the absence of a fuse, by portion 10*a* of the receptacle. Receptacle portion 10*b* provides reaction to the bias of contact 18*a*.

The recess that contains terminal portion 18*c* communicates to cavity 12 via slot 10*c* which conveniently extends as a groove all along cavity 12 (FIG. 12). Terminal 16 is essentially the same shape as terminal 18. They are assembled to the receptacle by way of appropriate reliefs 10*d* formed in receptacle body 10, and they are suitably held captive in their installed positions.

Contacts 16*a* and 18*a* are aligned with each other and with key 14 so that key 14 forms a protective shelf that overhangs the contacts. When no fuse holder is present (FIG. 13) the contacts 16*a* and 18*a* extend radially inward less than the radially inner margin of key 14. The arcuate extent of key 14 is also large enough to shield contacts 16*a* and 18*a*, viewing the receptacle endwise (FIG. 13). Assurance is provided in this way against contacts 16*a* and 18*a* acting as obstructions against insertion of a fuse holder, and conversely, key 14 protects contacts 16*a* and 18*a* against potentially damaging engagement by a fuse holder being inserted into the receptacle.

Fuse holder 20 is a one-piece body of molded insulation. It requires no shaping operations and no assembly operations, and therefore it can be manufactured very economically.

Fuse holder 20 includes a cover portion 22, a neck 24, a body portion 29 and spaced-apart end walls 26 and 28 at the ends of body portion 29. Cover 22 is somewhat larger than the diameter of cavity 12 of the receptacle. A slot 23 in the cover serves as an indicator, and the slot can receive a tool, if needed, to rotate the fuse holder in the receptacle. Neck 24 spaces cover 22 from end wall 26.

Groove 30 in fuse holder 20 extends all along body portion 29, through its end walls 26 and 28, and groove 30 has an arcuate extent of 90° (for example). Key 14 is received in groove 30 when the fuse holder is being inserted into the receptacle. The "radius" or maximum radial dimension of neck 24 is small enough to allow the fuse holder to rotate when key 14 is above upper end wall 26 of the fuse holder. However, neck 24 has a sector 24*a* of about 90° (for example) whose radius equals that of end wall 26.

Figure 6:
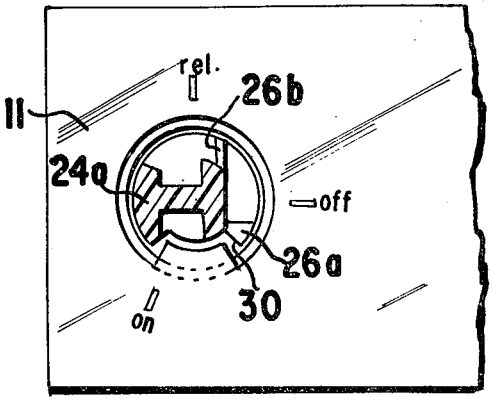

Referring to FIG. 6, groove 30 of the fuse holder is aligned with key 14 while the fuse holder is being inserted. When the fuse holder has been inserted fully, key 14 is opposite neck 24 and the fuse holder can then be rotated clockwise (looking down). The fuse holder is in what may be called its "switching location" when it has been inserted far enough to be rotated. After rotating about 100° (for example), the fuse holder reaches an "OFF" position (FIG. 5) and slot 23 in the top of the fuse holder becomes aligned with the "OFF" label on plate 11. During this rotation, the fuse holder is biased outward along its axis (upward in FIG. 4) by compression spring 31 at the bottom of cavity 12. In the "OFF" position of the fuse holder, the top surface of end wall 26 acts as a shoulder that presses against key 14 when manipulating pressure against cover portion 22 is relaxed. Two bumps 26*a* and 26*b* project upward from shoulder 26 (the top surface of end wall 26). Those bumps flank key 14 (FIG. 5) when spring 31 presses the upper surface of bearing 26 against key 14, arresting the fuse holder in its "OFF" position. In this setting, the exposed portions of fuse terminals T are spaced arcuately from contacts 16*a* and 18*a*.

The fuse holder can be pressed down or axially inward and rotated clockwise (looking down in FIG. 1) until neck portion 24*a* reaches key 14, the "ON" position of the fuse holder. When this position is reached, bump 26*b* and neck portion 24*a* flank key 14. Upon release of manipulating pressure on cover 22, spring 31 presses the fuse holder upward so that bump 26*b* and neck portion 24*a* arrest the fuse holder in its "ON" setting. Contacts 16*a* and 18*a* wipe against fuse terminals T (FIG. 7).

Neck 24 is longer (along its axis) than the thickness of plate 11. See clearance C in FIG. 4. Consequently, the fuse holder can be shifted deeper into the receptacle cavity, far enough for bumps 26*a* and 26*b* to be freely rotatable past key 14. When manipulating pressure on cover 22 is relaxed in either the "OFF" or the "ON" position of the fuse holder, spring 31 then can shift the fuse holder upward for shoulder or top wall 26 to engage key 14 and to restore clearance C. As will be seen below, the body of the fuse holder has grooves 36 that receive contacts 16*a* and 18*a*, and those grooves are wider than those contacts (along the axis of rotation) for accommodating the axial shift of the fuse holder into and out of detented position relative to key 14.

From the foregoing, it is apparent that shoulder 26 and key 14 form detenting obstructions preventing removal of the fuse holder in the "ON" and "OFF" positions of the fuse holder. In the "REL." position of the fuse holder (FIG. 6) there is nothing restraining the fuse holder which, accordingly, is partially ejected by the spring. This is an advantage where, as in the apparatus in the drawings, the fuse holder lacks an external projection that can be gripped and pulled. In the "release" position of the fuse holder, contacts 16*a* and 18*a* are out of engagement with the fuse and the fuse holder, so that the fuse holder is freely moved outward by spring 31 and thus easily removed.

Body portion 29 of the fuse holder has a cavity 32 extending between end walls 26 and 28 for receiving "glass" fuse F. This fuse comprises metal end caps that constitute cylindrical terminals T, a glass-tube wall W and a fusible link L connected between the terminals T. Cavity 32 extends from one end wall 26 of body 29 to the other end wall 28, and it is defined in part by resilient walls 34 that embrace the fuse and have turned-in tips 34*a* to retain the fuse releasably in the fuse holder cavity 32. A slot 29*a* is formed in body 29. A tool can be inserted into slot 29*a* to eject the fuse. Body 29 of the fuse holder (including its end walls 26 and 28) largely conceals each fuse terminal T. Fuse F, which itself is essentially cylindrical, has its axis located eccentric of the fuse holder axis established by the portions of body 29 (including its end walls 26 and 28) that rotates in cavity 12. Annular grooves 36 in body 29 allow contacts 16*a* and 18*a* to extend into cavity 12 of the receptacle.

As already noted, the portions of fuse terminals T that are outermost relative to the fuse-holder axis are exposed for contact by the receptacle contacts 16*a* and 18*a*. As seen particularly in FIG. 7, the laterally exposed portion of the fuse is displaced by a substantial angle from groove 30 in body 29, while key 14 and contacts 16*a* and 18*a* are in a row (FIG. 13) along a line parallel to the axis of rotation of the fuse holder, the axis of cavity 12. This arrangement (or an equivalent) compels insertion of the fuse and fuse holder into the receptacle in a position that must be followed by rotation of the fuse holder before the fuse terminals can engage either of the receptacle terminals. The configuration also enables the fuse holder to be rotated far enough to be retained in the receptacle yet not far enough for the fuse terminals to engage contacts 16*a* and 18*a*, thus providing a switching capability. (Of course the parts may be modified so that the "ON" position is reached by the fuse holder after its initial displacement from the "release" position, and the "OFF" position could be reached by further rotation.) The entire construction provides protection against any possible hazard that might arise if either terminal (and therefore both terminals) were to be energized momentarily during insertion or removal of the fuse holder.

The foregoing represents the presently preferred embodiment of the invention in its various aspects. It is obvious that some of the features shown and described can be omitted while other novel features are retained. Also, many modifications and rearrangements may be introduced by those skilled in the art. For example, key 14 and the interrupted circular shoulder with which it cooperates can be reversed so that the key would become a projecting part of the fuse holder and the interrupted circular shoulder would become a relief in the receptacle. In a further modification, the fuse may be coaxial with respect to the fuse holder (not eccentric) so as to be rotatable about an axis coinciding with the receptacle axis, retaining the other features of the embodiment detailed above; and in this modification, engagement of the outward exposed portions of the fuse with the receptacle contacts may be assured by allowing appropriate inward flexing of the receptacle contacts or by biasing the fuse holder laterally and allowing it to shift off its axis toward the receptacle contacts upon rotation into its circuit making orientation. Moreover, in a still further modification, terminal 18 may be omitted and in its place, spring 31 may be formed as a contact engaging the lower end of a fuse terminal T, relieving the bottom of the fuse holder so as to provide an aperture for the modified spring-contact to engage the fuse. These are but a few of the modifications that may be introduced by those skilled in the art, retaining some of the advantages of the embodiment described in detail above. Consequently the invention should be construed broadly in accordance with its true spirit and scope.

What is claimed is:

1. Switching fusible apparatus comprising a fuse holder and a receptacle therefor, said receptacle having a cavity with an opening and a pair of contacts at different distances from the opening, said fuse holder when in its switching location in the receptacle being rotatable about an axis to assume "release", "off" and "on" positions and, when in said "release" position, being movable along said axis for removal from and insertion into the cavity, said fuse holder being formed to contain a fuse having spaced-apart end caps positioned for engagement with the receptacle contacts, respectively, when the fuse holder is in its "on" position, at least one of said receptacle contacts being spaced from a respective one of the fuse end caps when the fuse holder is in its "off" position, said receptacle and said fuse holder having respective detenting obstructions that are mutually cooperable when the fuse holder is in either said "on" position or said "off" position for both blocking axially outward movement of the fuse holder and retaining the fuse holder against rotation out of either selected "on" or "off" position, the fuse holder being movable axially inward to release the mutual cooperation of the detenting obstructions, the extent of said obstructions being limited so that the fuse holder is free for axial insertion into and removal from the receptacle in said "release" position, said apparatus having spring means biasing the fuse holder axially outward for effecting said cooperation of the detenting obstructions in each of the "on" and "off" positions of the fuse holder.

2. Switching fusible apparatus as in claim 1 wherein said spring means is a spring insulated from said contacts.

3. Switching fusible apparatus as in claim 1 wherein said fuse holder comprises a body of insulation formed as aforesaid to contain the fuse with its end caps only partly exposed and wherein said spring means is a spring bearing against the end of the fuse holder farthest from said opening, said spring being insulated from the fuse by said body of insulation.

4. Switching fusible apparatus as in claim 1 or 3 wherein said contacts project into the receptacle cavity and wherein said fuse holder has a longitudinal groove at the side thereof that is aligned with said contacts in its "release" position, the groove being deep enough to avoid engagement of those contacts by the fuse holder during its insertion and removal.

5. Switching fusible apparatus as in claim 1 wherein said fuse holder comprises a body of insulation having a channel-shaped portion formed as aforesaid to contain a fuse and having an open side formed to admit the fuse laterally, said body of insulation having a hole therein opposite to its open side for admitting a fuse-ejecting tool.

6. Switching fusible apparatus as in claim 5 wherein at least one portion of the body of insulation is formed as a resilient fuse retainer.

7. Switching fusible apparatus as in claim 1 wherein said detenting obstructions have relatively recessed and projecting formations that are cooperable as aforesaid for retaining said fuse holder against rotation out of either selected "on" or "off" position.

8. Switching fusible apparatus as in claim 1 or 7 wherein said fuse holder comprises a body of insulation formed as aforesaid for containing a fuse, and wherein the insulation forming said body integrally provides the detenting formation of the fuse holder.

9. Switching fusible apparatus as in claim 1, wherein said detenting formations include portions that block rotation of the fuse holder from its "on" position directly to the "release" position and, correspondingly, block rotation of the fuse holder from its "release" position directly to its "on" position.

10. Switching fusible apparatus as in claim 5, wherein said contacts project into the receptacle cavity and wherein said fuse holder has a longitudinal groove at the side thereof that is aligned with said contacts in its "release" position, the groove being deep enough to avoid engagement of those contacts by the fuse holder during its insertion and removal.

* * * * *